United States Patent [19]

Hallström

[11] Patent Number: 5,016,535

[45] Date of Patent: May 21, 1991

[54] ARRANGEMENT FOR MINE CONSTRUCTION

[75] Inventor: Stig Hallström, Karlskoga, Sweden

[73] Assignee: Aktiebolaget Bofors, Bofors, Sweden

[21] Appl. No.: 409,663

[22] Filed: Sep. 20, 1989

[30] Foreign Application Priority Data

Sep. 20, 1988 [SE] Sweden ..... 8803318

[51] Int. Cl.[5] ..... F42B 22/10

[52] U.S. Cl. ..... 102/411; 102/401; 102/406; 102/317

[58] Field of Search ..... 102/411, 406, 317, 320, 102/401, 407

[56] References Cited

U.S. PATENT DOCUMENTS

| | | | |
|---|---|---|---|
| 4,183,301 | 1/1980 | Burke et al. | 102/411 |
| 4,221,166 | 9/1980 | Bjork et al. | 102/411 |
| 4,230,040 | 10/1980 | Bjork et al. | 102/411 |
| 4,317,414 | 3/1982 | Grawe et al. | 102/406 |
| 4,691,637 | 4/1987 | Leigh | 102/406 |

FOREIGN PATENT DOCUMENTS 0137713 4/1985 European Pat. Off. .

*Primary Examiner*—Harold J. Tudor

*Attorney, Agent, or Firm*—Pollock, Vande Sande & Priddy

[57] ABSTRACT

A mine assembly comprises at least one charge module having a cylindrical shape, and an upper and lower circular surface end. An activating module for detonating the at least one charge module is operatively connected thereto. The activating module has at least a lower cylindrical end and interconnecting means provided at the upper circular end of the charge module. The interconnecting means includes a ring-shaped element having an inner diameter which corresponds to an outer diameter of the lower end of the activating module and to a diameter of other charge modules. The ring-shaped element forms an upwardly extending projection along the circular upper end surface of the charge module to provide a space thereon adapted for receiving a cylindrical end of one of the modules.

11 Claims, 2 Drawing Sheets

ARRANGEMENT FOR MINE CONSTRUCTION

FIELD OF THE INVENTION

The present invention relates to an arrangement for mine construction which comprises activating means for controlling the mine function and one or more charges which can each be detonated by the activating means.

BACKGROUND ART

Today's mines are constructed depending on the various areas of use for the mines. Examples of different mines are ground clearance mines, floating mines, harbour mines, and the like. The ground clearance mines can be of a controlled or uncontrolled type. The floating mine comprises a so-called mine anchor as the bottom part and a floating part which contains the activating means and explosive. The harbour mines are smaller mines for the mining of harbours and harbour inlets with relatively shallow water.

As a result of the many different types of existing mines with varying amounts of explosives, the costs for development, production and storage are extremely high. Moreover, large storage spaces are required. In addition, different test equipment and servicing intervals are required for maintenance.

SUMMARY OF THE INVENTION

The main aim of the present invention is to provide an arrangement which solves, among other things, the problem described above. The feature which may chiefly be regarded as characterizing the new arrangement is that the mine construction comprises two different types of standardized modules, of which the first module forms an activating part bearing the activating means and the second module forms a charge part or explosive part which contains one or more charges (explosive compositions), and that the charge part is designed so that it can be joined together with both the floating part and other charge parts.

In further developments of the inventive concept each charge part is designed, as regards its connection with one or more other charge parts, so that it can be disconnected from other charge parts after being dropped in order to permit spreading of the charge parts on the sea bed.

In one preferred embodiment each charge part can be joined together with a ring in its lower section for permitting use of the charge part as a bottom part in the mine construction. The charge or charges in each charge part can be exchangeable with or replaced by a ballast for producing an anchor module in the mine construction.

In one embodiment, one or more charge parts joined together can form an anchor for the mine construction. Each charge in each charge part can be detonated at the same time or with a certain time difference in relation to one or more charge parts which are joined together with the activating (module) part.

In order to permit the connections, in one embodiment each charge part is provided in its upper section with a ring-shaped or projecting member, via which the instrument part or another charge part can be set down via its bottom section and arranged securely by locking members, for example screws, snap members, catch surfaces and the like, which can be activated manually and/or automatically. In a further embodiment, the activating part and/or each charge part is provided with a pressure-sensing member, for example a hydrocell, which is designed to release each locking member at a predetermined pressure in order to achieve the separation.

Each charge part (module) can comprise a rotationally symmetrical container for containing the associated charges.

By means of the module system described above, it is possible in a simple manner to reduce the number of stored mine types. Maintenance is simpler as a result of uniform construction of the activating means. It is easy to assemble, as required, the types of mines necessary for each particular case. For example, it is possible to assemble a module mine which can be dropped from various types of vessels or helicopters. Due to its rotationally symmetrical shape, it is easy to roll such mine off from surface vessels. All the handling equipment which is necessary in connection with mines can be standardized. The proposed arrangement affords considerable economic advantages. The costs of developement and production can be made considerably less than in the case where use is made of special mines for each type of task.

A preferred embodiment of an arrangement which shows the characteristic features significant to the invention will be described hereinbelow with simultaneous reference to the attached drawings, in which

DETAILED DESCRIPTION OF THE PREFERRED EMBODIMENT(S)

Figure 1:
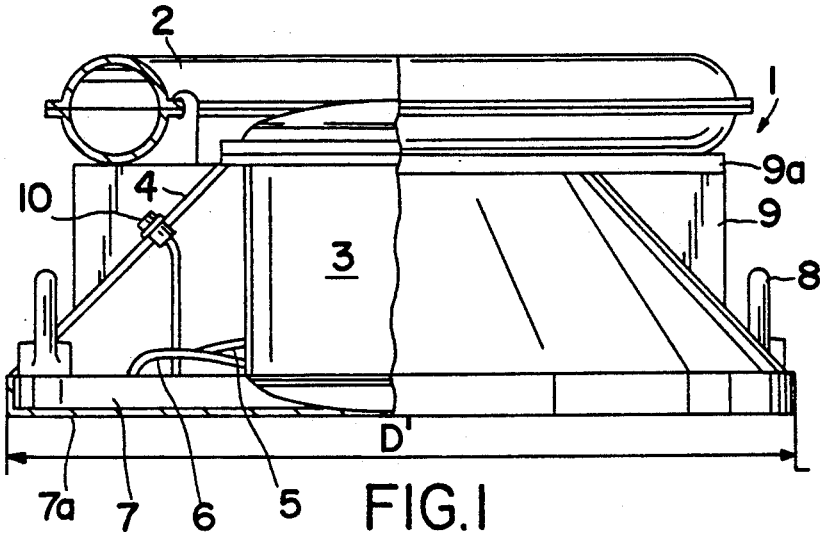
FIG. 1 shows, in side view, one embodiment of an activating part included in the module mine.

The activating part (module) is indicated by 1. This part comprises a floating member 2 in the form of a ring made of readily buoyant material, cork or the like. The ring can also be inflated with a light gas, for example air. The floating part comprises a container 3 which includes activating means of a type known in the art. The container is arranged in a conical part 4 which is provided with a recess in which the container is accommodated. The container and the conical part are tight-fitting and in this way have intrinsic buoyancy. An electric connection member 5 for an electric cable 6 is shown in the figure. External equipment can be connected via this connection to the activating means inside the container 3. The mine can be included in a remote-control system, in which actuation can be effected via the cable and connection. Alternatively or in addition, the connection can also symbolize the connection to other parts in the assembled module mine. At its bottom the activating part has a securing ring 7 via which the part 1 can be joined together as described below. The activating part can also be provided with lifting members, for example lifting eye bolts 8. The floating part 2 is connected to the conical part via plateshaped securing parts 9 arranged on the edge. A further electric connection is indicated by 10. This connection can symbolize electric connection to other parts (charges) in the mine construction.

The activating part (module) is made of conventional material, for example steel, alloy, plastic and the like, which is in this context.

Figure 2:
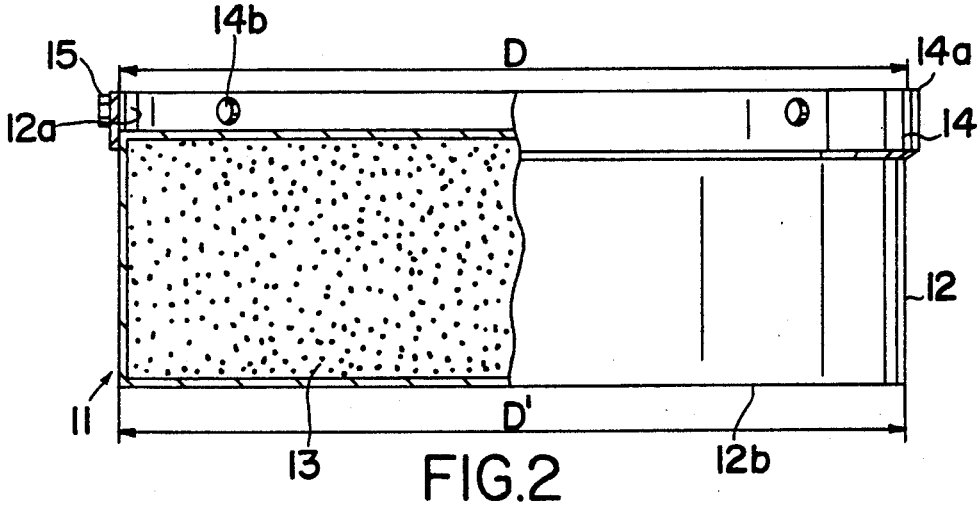
FIG. 2 shows, in side view, an embodiment of a charge part.

In FIG. 2 a charge module or charge part is indicated by 11. In the preferred embodiment this part consists of a rotationally symmetrical container 12 made of a material which is conventional for mines, for example steel or the like. The container includes an explosive composition 13 which can consist of trinitrotoluene, for example. The size of the explosive composition can be chosen within wide limits and can consist, for example, of 150 kg of explosive composition. At its top the module is provided with a ring 14, the edge 14*a* of which projects upwards beyond the container surface 12*a*. The ring is secured on the container (for example by welding, riveting and the like) and is provided with threaded holes (not shown specially) which are evenly distributed along the periphery of the ring. The number of holes can be 4, for example. The ring has an internal diameter D which exceeds the external diameter D' of the ring 7 according to FIG. 1. The part 1 according to FIG. 1 can in this way be set down on the ring 14 so that the underside 7*a* rests against the top surface 12*a* of the container 12. The part 1 can be secured to the part 11 by means of screws (bolts) 15 which are not specially shown and which are screwed into the threaded holes so that their front ends cooperate with the side surface of the ring 7 of part 1 in a known manner.

The part 11 has in its lower sections a diameter dimension D', which corresponds to the diameter dimension of the ring 7 in FIG. 1. In this way, the part 11 can in turn be set down on a ring which corresponds to the ring 14 on another charge module, and so on.

Figure 3:
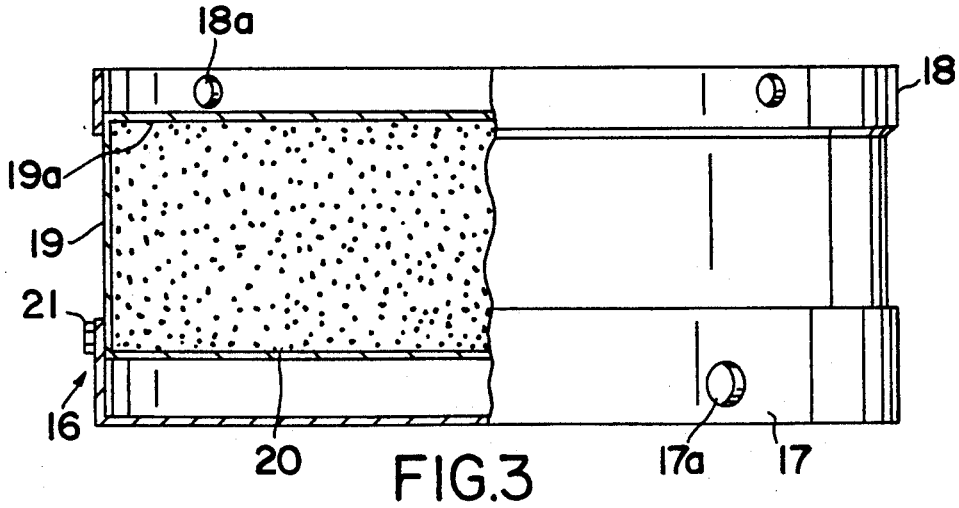
FIG. 3 shows, in side view, an example of how the charge part can be provided with a bottom ring in order to form an anchor for the module mine.

In FIG. 3 reference 16 denotes a charge module which corresponds to the charge module according to FIG. 2, but which is supplemented with a bottom ring at its lower sections. The part 16 is provided in its upper sections with a ring 18 which corresponds to the ring 14 on part 11 in FIG. 2. The container 19 of part 16 has a top surface 19*a* which corresponds to the top surface 12*a* of the container 12 in FIG. 2. The part 11 according to FIG. 2 can thus be set down on the ring 18 in such a way that its bottom surface 12*b* rests on the top surface 19*a*. The part 16 can be provided with an explosive composition 20 which can be exchanged for a ballast of a known type. The bottom ring 17 can be arranged over the lower sections of part 16 and secured by means of screws 21 or the like in the part 16. The screws are screwed in from the outside so that the free ends cooperate with the outside of the container 19. The rings mentioned above are provided with inspection holes 14*b*, 18*a* and 17*a*, for example four holes in each ring.

Figure 4:
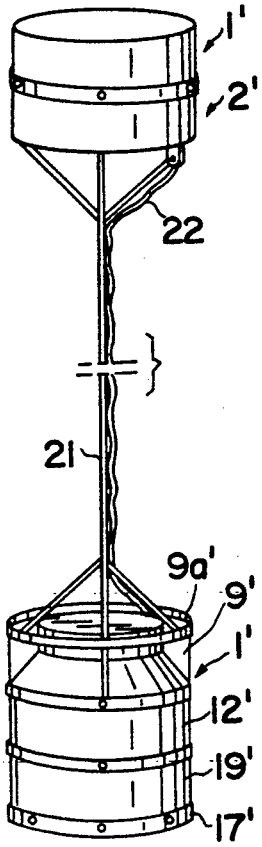
FIG. 4 shows, in a perspective view obliquely from above, one embodiment of the assembly of a module mine.

FIG. 4 shows an example of a complete mine construction. The mine construction has an activating part 1' and a charge part 2' connected to the latter. These parts are connected to an anchor part which comprises from the bottom a charge part 19' provided with a bottom ring 17', and a further charge part 12' connected to the charge part 19'. The charge part 12' is in turn connected to an instrument part 1''. The line between the unit which comprises the parts 1' and 2' and the unit which comprises the parts 12', 19' and 1'' is indicated by 21 and can consist of an anchor line (steel wire) of known type. An electric cable or line 22 can be arranged on the anchor line, via which electric cable or line 22 the activating means in part 1' and 1'' are in contact with each other. When the part 1' is detonated, the activating means in part 1'' is actuated so that the detonations take place in coordinated manner or in accordance with a predetermined pattern for the different charge parts.

Figure 5:
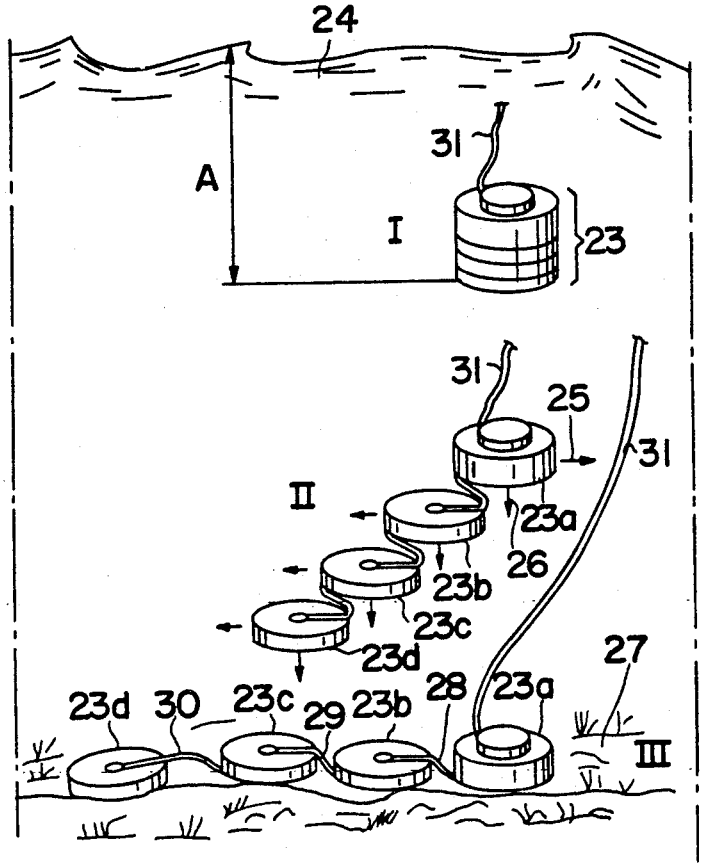
FIG. 5 shows, in a perspective view seen obliquely from the right, how a module mine can be divided into three different function stages.

FIG. 5 shows three different function stages for a module mine according to the invention. The three different stages are indicated by I, II and III. In stage I the mine 23 has reached a distance A below seal level 24. At stage II the pressure-sensing member has activated the securing member for the modules 23*a*–23*d* of the mine, the result of which is that the modules have begun to spread in the water. The direction arrows 25, 26 for each module unit are shown in the figure. At stage III the spread has been completed and the module parts lie spread out on the sea bed 27. The extent of the spread is determined by the line parts 28, 29 and 30 which hold the module parts together. The line which connects the activating part 23*a* with, for example, a boat on the surface of the sea 24 is indicated by 31. The illustrated spread of the module parts, which is brought about during their movement towards the bed 27, increases the effect of the module mine when it is detonated.

Figure 6:
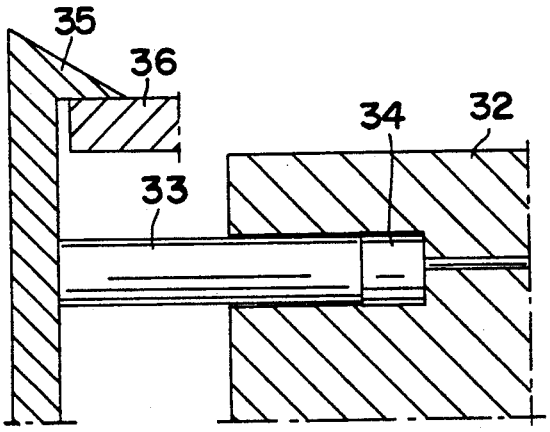
FIG. 6 shows, in vertical section, a basic view of parts of the securing members which can be released by a pressure-sensing member.

FIG. 6 shows an example of how a member holding the module units together can be released by means of a pressure-sensing member 32 which can be of a known type. The member 32 comprises a displaceable part 33 which is displaced when the pressure in a chamber 34 exceeds a certain value as a result of the exerted water pressure. In this case the securing or locking member consists of a catch 35 which, in the locked positon, bears against a catch surface 35 is removed from its position in which it cooperates with the catch surface 36, resulting in the disconnection function being activated. The forces arising on account of the movements in the water (arrows 25, 26) on the various module parts of the mine effect the spreading function.

The invention is not limited to the preferred embodiment described above as an example, but can be subjected to modifications within the scope of the following patent claims and inventive concept.

What is claimed is:

1. A mine assembly, comprising:

at least one charge module having a cylindrical shape, and an upper and lower circular surface end;

an activating module for detonating said at least one charge module operatively connected thereto, said activating module having at least a lower cylindrical end;

interconnecting means provided at said upper circular end of said charge module and including a ring-shaped element having an inner diameter which corresponds to an outer diameter of said lower end of said activating module and of other charge modules, said ring-shaped element forming an upwardly extending projection along said circular upper end surface of said charge module to provide a space thereon adapted for receiving a cylindrical end of one of said modules.

2. A mine assembly according to claim 1, wherein said charge modules are disconnectable after being dropped in order to permit spreading of said charge modules on a sea bed.

3. A mine assembly according to claim 1, wherein at least one of said charge modules is adapted to form an anchor for the mine assembly and wherein charges in said at least one charge module forming said anchor can be detonated at the same time as at least one charge module which is connected to said activating module.

4. A mine assembly according to claim 1, further comprising locking members for securing each charge module to said activating module or another charge module, at least some of said locking members being activatable and deactivatable manually.

5. A mine assembly according to claim 4, wherein said activating module and said each charge module are provided with a pressure-sensing member which is adapted to release each locking member at a predetermined pressure.

6. A mine assembly according to claim 1, further comprising locking members for securing each charge module to said activating module or another charge module, said locking members being activatable and deactivatable automatically.

7. A mine assembly according to claim 6, wherein said activating module and said each charge module are provided with a pressure-sensing member which is adapted to release each locking member at a predetermined pressure.

8. A mine assembly according to claim 1, wherein each charge module comprises at least one charge.

9. A mine assembly, comprising:

a plurality of charge modules, each charge module having a cylindrical shape and an upper and lower circular surface end;

an activating module for detonating said each charge module operatively connected thereto, said activiating module having at least a lower cylindrical end;

interconnecting means provided at said upper circular end of said each charge module and including a ring-shaped element having an inner diameter which corresponds to an outer diameter of said lower end of said activating module, said ring-shaped element being secured to the upper end of said each charge module so as to extend beyond said circular end surface to provide a space thereon adapted for receiving a cylindrical end of one of said modules.

10. A mine assembly according to claim 9, wherein charges in at least some of said charge modules are replaced by ballasts for providing an anchor module for the mine assembly.

11. A mine assembly according to claim 9, wherein a plurality of said charge modules are adapted to form an anchor for the mine assembly and wherein charges in said at least one charge module forming said anchor can be detonated at the same time as at least one charge module which is connected to said actuating module.

* * * * *